United States Patent [19]

Kelsall

[11] Patent Number: 4,739,460

[45] Date of Patent: Apr. 19, 1988

[54] SPRING CLIPS FOR A RECESSED LIGHT FIXTURE

[75] Inventor: Jeffrey C. Kelsall, Roselle, Ill.

[73] Assignee: Cooper Industries, Inc., Houston, Tex.

[21] Appl. No.: 789,918

[22] Filed: Oct. 18, 1985

Related U.S. Application Data

[63] Continuation of Ser. No. 638,247, Aug. 6, 1984, abandoned.

[51] Int. Cl.[4] ..... F21S 1/06

[52] U.S. Cl. ..... 362/365; 362/368

[58] Field of Search ..... 362/150, 365, 148, 366, 362/368, 370, 147, 364, 371

[56] References Cited

U.S. PATENT DOCUMENTS

| | | | |
|---|---|---|---|
| 2,965,348 | 12/1960 | Gerstel et al. | 248/343 |
| 3,018,083 | 1/1962 | Bobrick | 248/343 |
| 3,308,288 | 3/1967 | Ades | 362/150 |
| 3,383,811 | 5/1968 | Ades | 362/150 |
| 3,885,147 | 5/1975 | Chacon | 362/150 |
| 4,175,281 | 11/1979 | Lonseth | 362/148 |
| 4,250,540 | 2/1981 | Kristofek | 362/368 |

FOREIGN PATENT DOCUMENTS

| | | | |
|---|---|---|---|
| 223098 | 7/1959 | Australia | 362/365 |
| 249102 | 1/1964 | Australia | 362/365 |
| 253441 | 8/1964 | Australia | 362/365 |
| 1013237 | 8/1957 | Fed. Rep. of Germany | 248/343 |
| 1268272 | 6/1961 | France | 362/365 |
| 1304849 | 8/1962 | France | 362/365 |
| 1520786 | 4/1968 | France | 362/365 |

*Primary Examiner*—Craig R. Feinberg
*Assistant Examiner*—David A. Okonsky
*Attorney, Agent, or Firm*—E. E. Scott; A. R. Thiele

[57] ABSTRACT

A recessed remodeling light fixture adapted for mounting in an opening within a ceiling includes a cylindrical housing having a wall and an open end. The wall has a pair of opposed and aligned elongated slots disposed above the open end. A pair of spring clips is disposed in the slots and inside the housing during shipping and prior to installation. The clips are adapted to rotate outwardly for securing the housing above the ceiling in an installed position. Each of the clips has a wide body portion, a narrow leg member, and a foot portion. The leg member has a first bend adjacent the body portion and a second bend adjacent the foot portion so as to form a partial loop.

20 Claims, 1 Drawing Sheet

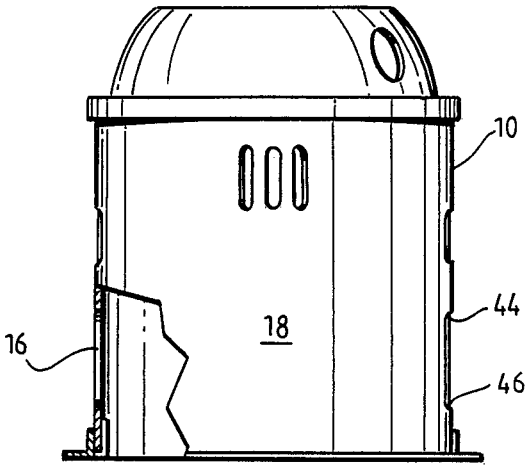
Fig.1
Fig.2
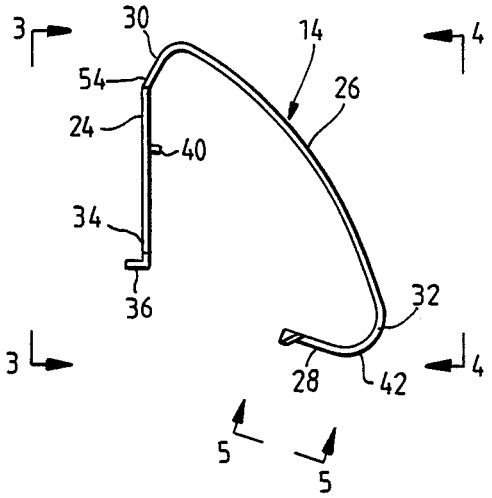
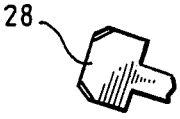
Fig.5
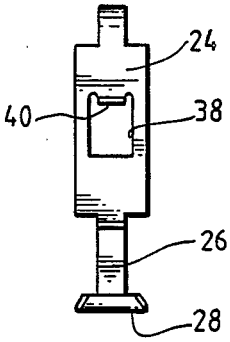
Fig.3
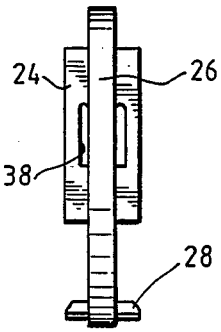
Fig.4
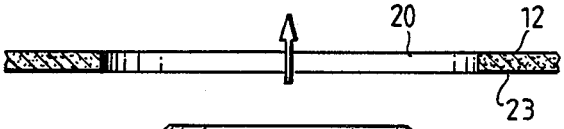
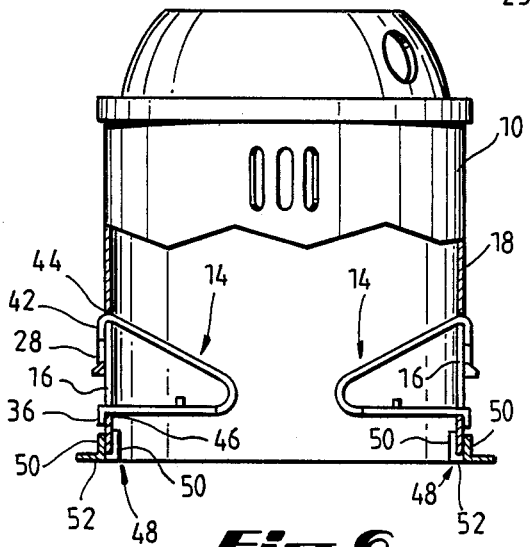
Fig.6
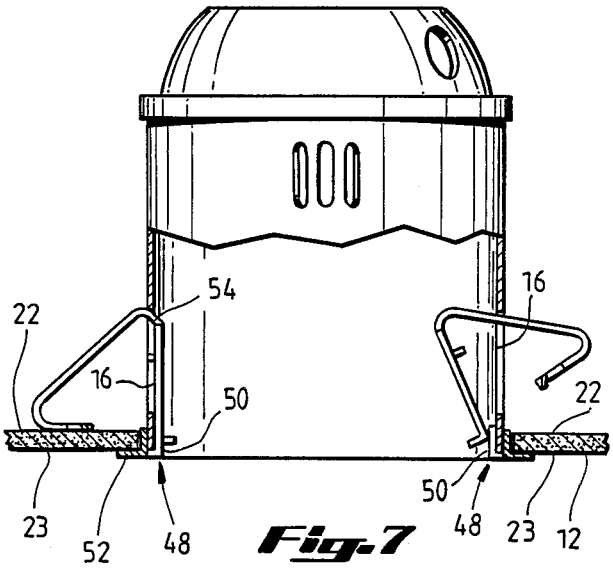
Fig.7

SPRING CLIPS FOR A RECESSED LIGHT FIXTURE

This application is a continuation of application Ser. No. 638,247, filed Aug. 9, 1984, now abandoned.

BACKGROUND OF THE INVENTION

This invention refers generally to recessed ceiling lighting fixtures and more particularly, it relates to improved spring clips for holding a recessed remodeling fixture in a ceiling opening.

A prior art search directed to the subject matter of this application in the U.S. Patent and Trademark Office revealed the following U.S. Letters Patents: U.S. Pat. Nos. 2,965,348, 3,018,038, 3,308,288, 3,383,811, 3,885,147, 4,175,281.

Further, during the course of the search the following foreign patents were developed: French Pat. Nos. 1,268,272; 1,304,849; and 1,520,786; Australian Pat. Nos. 249,102 and 253,441; and German Pat. No. 1,013,237.

None of the prior art uncovered in the search disclosed a spring clip for holding a recessed remodeling lighting fixture in a ceiling opening like that of the present invention which includes a wide body portion, a narrow leg member, and a foot portion. The leg member has a first bend adjacent the body portion and a second bend adjacent the foot portion so as to form a partial loop. The clip is retained in a slot and is disposed inside of a cylindrical lighting fixture during shipment and prior to installation. The clip is adapted to rotate outwardly for securing the housing above a ceiling in an installed position.

SUMMARY OF THE INVENTION

Accordingly, it is a general object of the present invention to provide an improved spring clip for holding a recessed remodeling lighting fixture in a ceiling opening.

It is an object of the present invention to provide a spring clip for holding a light fixture to a ceiling structure which includes a wide body portion, a long narrow twice bent leg member and a wide flat portion.

It is another object of the present invention to provide a recessed remodeling light fixture adapted for mounting in an opening in a ceiling which includes a cylindrical housing having a pair of opposed elongated slots disposed in the housing wall and a pair of spring clips being disposed in the slot and inside of the housing during shipment and prior to and during installation.

It is still another object of the present invention to provide a spring clip which permits easy and secure mounting of a recessed remodeling light fixture without the necessity of special tools for installation.

It is yet still another object of the present invention to provide a spring clip which is inexpensive in cost and is relatively simple to manufacture.

In accordance with these aims and objectives, there is provided in the present invention a recessed remodeling light fixture adapted for mounting in an opening within a ceiling which includes a cylindrical housing having a wall and an open end. The wall is provided with a pair of opposed and aligned elongated slots disposed above the open end. A pair of spring clips is disposed in the slots and is inside the housing during shipment and prior to installation. The clips are adapted to be rotated outwardly for securing the housing above the ceiling in an installed position. Each of the clips has a wide body portion, a narrow leg member, and a foot portion. The leg member has a first bend adjacent to the body portion and a second bend adjacent the foot portion so as to form a partial loop.

These and other objects and advantages of the present invention will become more fully apparent from the following detailed description when read in conjunction with the accompanying drawings with like reference numerals indicating corresponding parts throughout.

BRIEF DESCRIPTION OF THE DRAWINGS

FIG. 1 is a side elevational view of a recessed remodeling lighting fixture, according to the present invention;

FIG. 2 is a side elevational view of a spring clip of the present invention;

FIG. 3 is a view taken along the lines 3—3 of FIG. 2;

FIG. 4 is a view taken along the lines 4—4 of FIG. 2;

FIG. 5 is a view taken along the lines 5—5 of FIG. 2;

FIG. 6 is a side elevational view of the lighting fixture with the spring clips disposed therein prior to installation in the ceiling opening, according to the present invention; and FIG. 7 is a side elevational view of the lighting fixture with the spring clips extending outwardly therefrom, being installed in the ceiling opening.

DESCRIPTION OF THE PREFERRED EMBODIMENT

Referring now in detail to the varicus views of the drawing, there are shown in FIGS. 1 and 6 a recessed remodeling light fixture comprising a cylindrical can housing 10. The can housing 10 is adapted to be recessed inside a ceiling illustrated diagramatically by reference numeral 12. The lighting elements or other structures which are normally mounted inside the can housing 10 are not shown.

A pair of snap spring clips 14 of special contour are utilized for holding the cylindrical can housing 10 within the ceiling 12. During shipment and before installation, the clips are disposed in a pair of opposed elongated slots 16 which are vertically aligned within the wall 18 of the can housing 10. Prior to installation of the housing through a mounting hole or opening 20 in the ceiling 12, a pair of snap spring clips 14 are contained substantially in their entirely within or inside of can housing 10, so that a portion of the clips are flush with the outer surface of the wall 18. This permits can housing 10 to be raised vertically through and pushed substantially above ceiling opening 20. In use, the spring clips 14 are rotated outwardly to bear against the upper subceiling surface 22 for retaining securely can housing 10 within the ceiling as will be explained in greater detail hereinafter.

As can best be seen from FIGS. 2 through 5, the snap spring clip 14 has a wide rectangularly-shaped body portion 24, a long narrow twice bent leg member 26, and a relatively wide flat foot portion 28. The leg member extends between body portion 24 and foot portion 28 so that it is formed with a first bend 30 of greater than 90 degrees adjacent the top (as viewed in FIG. 2) of body portion 24 and with a second bend 32 back toward body portion 24 of greater than 90 degrees adjacent foot portion 28. Leg member 26 with its two bends form a partial loop with the body and foot portions. Due to the unique configuration of leg member 26, foot portion 28 normally extends below the bottom of the body portion 24 when the body portion is disposed in a vertical position. The bottom 34 of the body portion 24 is provided with a narrow perpendicular tab 36. At substantially the intermediate or mid-portion of body portion 24, there is provided a rectangular opening 38 which has a projection 40 extending from its upper end near the top of the body portion.

During shipping and installing of the light fixture housing, each of the spring clips 14 is disposed almost entirely within the housing in the position, as shown in FIG. 6. A small section 42 of second bend 32 in leg member 26 extends through the top end 44 of the elongated slot 16, and perpendicular tab 36 is hooked over bottom end 46 of elongated slot 16. Foot portion 28 is arranged completely outside of housing 10 so that it is flush with the outer surface of wall 18. In this position, spring clips 14 are under spring tension between top end 44 and bottom end 46 of elongated slot 16.

In order to install can housing 10 within ceiling 12, the housing is raised vertically and placed inside of mounting opening 20 in ceiling 12. The upward movement of the housing is limited by a plurality of L-shaped brackets 48. Vertical portions 50 of bracket 48 are operatively secured to the lower opened end of the can housing. A hroizontal portion 52 of brackets 48 abut the outer subceiling surface 23 so as to prevent further vertical travel of the housing into the ceiling. Thereafter, body portion 24 of each clip is resiliently pushed up toward leg member 26 so that clip 14 is compressed, thereby lifting the narrow tab 36 on the bottom 34 of body portion 24 above the bottom end 46 of elongated slot 16 to thereby release it. Simultaneously, second bend 32 adjacent foot portion 28 is released from the top end 44 of elongated slot 16. The narrow tab 36 is now moved to the inside of the can housing 10. The spring clip 14 can then be rotated outwardly so that the entire leg member 26, except for a small section 54 of first bend 30, is caused to slide through the elongated slot and outside housing 10.

As a result, foot portion 28 comes to rest and contacts the upper subceiling surface 22 and causes the spring tension of clip 14 to exert a force at the first bend 30 of leg member 26 adjacent the body portion 24 to the top end 44 of elongated slot 16 in the housing. This in turn causes a lever action to effect an outward pushing of the lower end of body member 24 against the inside surface of the can housing adjacent slot 16, thereby creating a spring tension on the entire clip. In order to properly locate and align rectangular opening 38 in body portion 24 within the elongated slot, the projection 40 is caused to extend engagingly through the elongated slot 16 and outside the housing 10. The projection 40 also prevents lateral movement of body portion 24 along wall 18 of the housing 10. This completes the installation of the light fixture and is shown in FIG. 7.

The spring clips are preferably constructed of a resilient material such as spring or sheet steel. This enables the clips to be formed in a simple bending and stamping operation, thereby realizing a relatively low cost in production. This unique spring clip configuration permits installation and secure mounting of the recessed remodeling light fixture in an easy, simple and rapid manner without the use of special tools.

From the foregoing detailed description, it can thus be seen that the present invention provides an improved snap spring clip adapted for mounting a recessed remodeling light fixture in an opening within a ceiling. The spring clip includes a wide body portion, a narrow leg member, and a foot portion. The leg member has a first bend adjacent the body portion and a second bend adjacent the foot portion so as to form a partial loop.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims.

What is claimed is:

1. A recessed remodeling light fixture adapted for mounting in an opening within a ceiling comprising:

a generally cylindrical housing having a wall and an opened end, said wall having a pair of opposed and aligned elongated slots disposed above said open end;

a pair of spring clips being disposed and resiliently retained in said opposed and aligned elongated slots substantially inside said housing during shipping and prior to installation of said light fixture, said clips constructed and arranged to rotate outwardly to provide a resilient mounting structure for securing said housing above the ceiling in an installed position; and each of said spring clips having a wide body portion, a narrow leg member and a foot portion, said leg member having a first bend adjacent said body portion and a second bend adjacent said foot portion so as to form a partial loop.

2. A recessed remodeling light fixture as claimed in claim 1, wherein said body portion has a narrow tab at the bottom end thereof, said tab being hooked over the bottom end of said slot when disposed inside said housing during shipping and prior to installation, thereby positioning said tab on the outside surface of said housing wall and said foot portion being disposed flush adjacent the top end of said slot on the outside surface of said housing wall during shipping and said second bend adjacent said foot portion being positioned against the top end of said slot so that said spring clip is under spring tension between the top end and the bottom end of said elongated slot during shipping.

3. A recessed remodeling light fixture as claimed in claim 2, wherein said body portion is compressed for releasing of said narrow tab at the bottom end of said body portion from the bottom end of said slot and said second bend from the top of said elongated slot so that said tab can be moved to the inside of said housing when said spring clip is rotated outwardly for securing said housing.

4. A recessed remodeling light fixture as claimed in claim 3, wherein said clip is rotated outwardly so that said leg member is disposed substantially outside said housing and said foot portion is caused to rest on the inner surface of the ceiling in the installed position, said body portion being disposed vertically adjacent the inside surface of said wall.

5. A recessed remodeling light fixture as claimed in claim 4, said body portion has an opening in its mid-portion and a projection extending from the upper end of said opening, said projection being disposed through said elongated slot to prevent lateral movement of said clip in said housing.

6. A recessed remodeling light fixture as claimed in claim 4, wherein said foot member causes spring tension of said clip to exert a force at said first bend to the top end of said slot which pushes the bottom end of said body portion against the inside surface of said housing, thereby creating a spring tension on the entire length of said clip.

7. A recessed remodeling light fixture as claimed in claim 1, wherein said first bend is greater than 90 degrees.

8. A recessed remodeling light fixture as claimed in claim 1, wherein said second bend is greater than 90 degrees.

9. A recessed remodeling light fixture as claimed in claim 4, wherein said foot portion is disposed below said body portion when said clip is in the installed position.

10. A recessed remodeling light fixture as claimed in claim 1, wherein said body portion is rectangular in shape.

11. A snap spring clip for holding a lighting fixture to a ceiling structure, said snap spring clip comprising:

a wide body portion;

a long narrow twice bent leg member having a first bend between said wide body portion and said leg member and a second bend located at the opposite end of said leg member from said first bend;

said leg member constructed and arranged to permit said first bend to be resiliently retained within said lighting fixture during shipping and resiliently positioned external to said fixture when mounted to a ceiling structure;

a wide flat foot portion;

said body portion being joined to said first bend and said foot portion being joined to said second bend;

said leg member being bent back around upon itself by said first and second bends so as to form with said body portion and said foot portion a partial loop; and said foot portion extending below the bottom end of said body portion when said body portion is disposed in a vertical position.

12. A snap spring clip as claimed in claim 11, wherein said body portion has a narrow tab disposed at its outer end.

13. A snap spring clip as claimed in claim 11, wherein said body portion has an opening in its mid-portion and a projection extending from its upper portion of said opening.

14. A snap spring clip as claimed in claim 11, wherein said first bend is greater than 90 degrees.

15. A snap spring clip as claimed in claim 11, wherein said second bend is greater than 90 degrees.

16. A snap spring clip as claimed in claim 11, wherein said body portion is rectangular in shape.

17. A snap spring clip as claimed in claim 11, wherein said clip is formed of a spring steel material.

18. In a recessed remodeling light fixture adapted for mounting in an opening within a ceiling, which light fixture is mounted in an easy and rapid manner without the use of special tools, comprising in combination:

a cylindrical housing having a wall and an open end, said wall having a pair of opposed elongated and aligned slots disposed above said open end;

a pair of spring clips disposed and resiliently retained in said opposed elongated and aligned slots and generally inside said housing during shipping and prior to installation, said clips constructed and arranged to rotate outwardly to provide a resilient mounting structure for securing said housing above said ceiling in an installed position; and each of said clips having a wide body portion, a narrow leg member and a foot portion, said leg member having a first bend adjacent the body portion and a second bend adjacent the foot portion so as to form a partial loop.

19. In a recessed remodeling light fixture as claimed in claim 18, wherein said wide body portion has a narrow tab at the bottom end thereof, said narrow tab being hooked over the bottom end of said elongated slot when disposed inside said housing during shipping and prior to installation on the outside surface of said housing and said foot portion being disposed flush adjacent the top of said elongated slot of the outside surface of said housing wall during shipping and said second bend adjacent said foot being positioned against the top of said slot so said clip is under spring tension between the top and bottom ends of said slot during shipping.

20. In a recessed remodeling light fixture as claimed in claim 19, wherein said body portion is compressed for releasing of said narrow tab at the bottom of said body portion from the bottom of said elongated slot and said second bend from the top of said elongated slot so that said narrow tab can be moved to the inside of said housing when said spring clip is rotated outwardly for securing said housing.

* * * * *